United States Patent [19]

Renaux et al.

[11] Patent Number: 4,738,758

[45] Date of Patent: Apr. 19, 1988

[54] PROCESS FOR CONTINUOUS DEPOSITION OF A ZINC-ALUMINUM COATING ON A FERROUS PRODUCT, BY IMMERSION IN A BATH OF MOLTEN METAL

[75] Inventors: Bruno Renaux, Jupille; Armand Davin, Boncelles; Andre Skenazi, Steenokkerzeel; Jean Yperman, Plainevaux, all of Belgium

[73] Assignee: International Lead Zinc Research Organization, Inc., Research Triangle Park, N.C.

[21] Appl. No.: 919,255

[22] Filed: Oct. 15, 1986

[30] Foreign Application Priority Data

Apr. 24, 1987 [BE] Belgium ..... 904675

[51] Int. Cl.[4] ..... C23C 28/00

[52] U.S. Cl. ..... 204/38.5; 427/310; 427/433

[58] Field of Search ..... 204/38.5, 38.1; 427/310, 433

[56] References Cited

U.S. PATENT DOCUMENTS 3,730,758 5/1973 Laidman ..... 204/38.5 X
4,390,377 6/1983 Hogg ..... 148/12 B
4,496,612 1/1985 McNutt et al. ..... 427/310

OTHER PUBLICATIONS

F. A. Lowenheim, Electroplating, McGraw-Hill Book Co., New York, 1978, pp. 180–182.

*Primary Examiner*—John F. Niebling
*Assistant Examiner*—William T. Leader
*Attorney, Agent, or Firm*—Brumbaugh, Graves, Donohue & Raymond

[57] ABSTRACT

There is disclosed a method of depositing a protective coating on a ferrous substrate comprising the steps of immersing the substrate in an electrolytic solution containing zinc chloride, a fluoride and at least one of $NiCl_2$ and $CoCl_2$, electrodepositing on said substrate a thin pre-coating comprising zinc, said electrolytic bath also functioning as a flux such that the thin electrodeposited coating comprising zinc will have thereon a flux coating as the substrate is removed from the electrolytic bath; removing the pre-coated substrate from the electrolytic bath, thereafter immersing the pre-coated substrate in a molten metal bath containing zinc so as to deposit a zinc-containing protective coating on said substrate, and removing said substrate from said molten bath.

19 Claims, No Drawings

PROCESS FOR CONTINUOUS DEPOSITION OF A ZINC-ALUMINUM COATING ON A FERROUS PRODUCT, BY IMMERSION IN A BATH OF MOLTEN METAL

BACKGROUND OF THE INVENTION

The present invention concerns a procedure for the continuous deposition of a zinc coating on a ferrous product by immersion in a bath of molten metal. Its aim is essentially to prolong the life of steel products, such as wires, tubes, and profiles or strips of steel. It applies to the method of particular interest in the case of coating in a bath of zinc containing aluminum.

It is known that the coating of steel products requires a pretreatment of the surface, for the purpose of assuring adherence, continuity and uniformity of the coating.

For certain of the aforesaid products, notably strips and wire, the preparation of the surface prior to immersion in the molten bath may consist of a thermal treatment in a reducing atmosphere. This avoids or removes all traces of oxygen or oxides on the surface of the product, which may then be immersed directly into the coating bath. Such a thermal treatment requires, however, expensive installations, and as a consequence large investments, which are not justified except in the case of important tonnages.

It is equally well known that, in the coating methods by means of dry fluxing, the preparation of the surface of the product generally comprises degreasing followed by rinsing, an acid cleaning also followed by rinsing, and a final dry fluxing. The product thus prepared is then immersed in the bath of molten metal, for example, zinc.

In this sequence of operations, the flux plays an important and multiple role. It serves especially to protect the cleaned and rinsed surface against all risk of reoxidation before introduction of the product into the zinc bath. It likewise allows the elimination of iron salts from being able to exist on the surface in spite of the rinsing performed after the cleaning, and thereby avoids their incorporation in the zinc bath. This operation is effected, in the classical way, by immersing the product in a flux consisting of an aqueous solution of zinc and ammonium chlorides.

This flux, employed for many years, plays its role of protection in a satisfactory manner as long as the coating to be deposited later is composed of practically pure zinc.

Recently, new types of zinc-aluminum coatings have been developed. These new coatings offer, depending on their composition, improved properties of ductility and adherence. These properties are very interesting, for example in the case of pieces undergoing deformation, because this deformation does not cause cracking nor detachment of the coating. Also, the ability of this zinc-aluminum coating to resist corrosion and to receive a paint film is better than in the case of a classical zinc coating.

These improved properties, due to the presence of aluminum in the coating, are particularly noted in the case of an alloy recently developed which contains, in addition to zinc, from about 3 to 15%, and preferably about 5%, aluminum and trace quantities of mischmetal. Certain of these properties are likewise present when the coating contains more aluminum, for example, up to 70% aluminum.

Nevertheless, it has been ascertained that the application of the new type of coating on a surface prepared with the aid of a traditional flux may lead to various defects in the coating. In particular, some areas of the surface may not be covered, or not covered in a sufficient manner, or the coating may show black spots or even craters which give the surface an unacceptable finish.

It appears that these defects may be due to the formation of volatile compounds, notably $AlCl_3$, resulting from the reaction of the coating alloys with the constituents of the flux.

The deposition of the new zinc-aluminum coatings there pose a problem which, to the knowledge of the applicant, has not been resolved in a satisfactory manner up to the present time.

For example, a process is known from Belgian Patent BE-A-No. 897.788, comprising a preliminary immersion step in a bath consisting essentially of zinc and containing at least 0.5% aluminum, followed by a second immersion step in a zinc bath containing from 3 to 15% aluminum. This procedure, in which the first immersion step is preceded by a traditional fluxing, provides a coating of good quality and provides good corrosion resistance. However, it presents certain inconveniences, notably the necessity of providing and heating two coating baths, and the difficulty of controlling the composition of the Zn-Al bath, due on the one hand to the addition of zinc coming from the coated product in the first stage, and on the other hand, to the consumption of aluminum by diffusion in the Fe-Zn intermetallic layer formed during the second stage.

The present invention has for its object a process permitting the remedy of these inconveniences and the formation, by immersion in a single coating bath, of a zinc-aluminum coating which does not produce the aforesaid defects.

The procedure which is the object of the present invention is based on the discovery that the aforesaid defects are not apparent in the zinc-aluminum coatings when the flux is not deposited directly on the bare surface of the ferrous product. Rather, the present invention includes a process of continuously depositing a zinc-aluminum coating on a ferrous product, in which the said product is subjected to the operations of cleaning, rinsing, and immersion in a zinc-aluminum bath, and which is characterized by the fact that after the cleaning and rinsing operations, the aforesaid product is immersed in an aqueous solution containing a composition of at least one metal, from which solution is deposited by electrolytic means a thin layer of said metal on the surface of the product, and by the fact that after exiting the said solution, the product is dried and then immersed in the zinc-aluminum bath.

The composition of the electrolytic solution used in the process of the invention plays an important role in that it affects the quality of the final coating. According to the invention, the electrolytic solution not only enables the product to be pre-coated by electrolytic deposition, but this solution also provides fluxing properties.

In the circumstances, the applicant proposes to designate this solution by the name "Electrofluxing Solution", in order to express simultaneously the aspect of electrolysis and the aspect of fluxing. The layer of metal deposited by electrolysis is itself covered by a film having the composition of the electrofluxing solution, which film acts as a protective flux as the ferrous product is transferred from the electrolytic ("Electrofluxing") solution to the zinc-aluminum bath. In this regard, it is preferred that the electrolytic salt which provides the zinc ions for electrodeposition (e.g. $ZnCl_2$) also provides fluxing properties. Thus in its preferred embodiment, the electrofluxing solution contains at least one compound which functions both as an electrolytic salt and a flux.

The electrofluxing solution understandably must be compatible with the composition of the zinc-aluminum bath. According to one aspect of the process, an electrofluxing solution is used containing a chloride of the metal to be deposited (e.g. $ZnCl_2$), together with at least one other chloride or fluoride. Such a solution might contain from 100 to 700 g/l of $ZnCl_2$, from 5 to 100 g/l of at least one chloride such as NaCl, KCl, $CaCl_2$, and from 1 to 10 g/l of at least one fluoride such as NaF, HF, KF.

The content of $ZnCl_2$ preferably is at least 100 g/l, in order to assure a sufficient supply of zinc for the electrolytic deposition; however, it is preferred that it not exceed 700 g/l so as not to produce too great a thickness in the deposit.

The role of chlorides (NaCl, KCl, $CaCl_2$ . . . ) is to increase the mobility of the zinc ions and thereby to improve the efficiency of the deposition reaction. The fluorides (NaF, KF, HF . . . ), present at the preferred concentrations, increase the cleaning power of the electrofluxing solution.

According to a preferred aspect of the process of the invention, the electrofluxing solution also contains, in the amount of 1 to 50 g/l, a chloride of at least one of the metals of the group comprising nickel and cobalt. The addition of $NiCl_2$ and/or $CoCl_2$ to the electrofluxing solution surprisingly leads to a supplementary improvement in the quality of the final coating. This favorable result may be due to the formation, by electrolysis, of a Zn-Ni or Zn-Co layer, but so far the mechanism of the influence of such a layer on the quality of the final coating has not actually been determined.

Likewise, according to the invention, the pH of the electrofluxing solution is adjusted to a value between 0.5 and 3, and preferably as close as possible to 1.

In fact, a pH above 3 does not permit the desired cleaning to be assured, whereas a pH below 0.5 causes evolution of hydrogen on the cathode, but does not bring about metal deposition. In the first case, for example, the pH value may be adjusted by an addition of hydrochloric acid, in the case where the upper limit of fluorides mentioned may not be sufficient.

Still according to the invention, the temperature of the electrofluxing solution preferably is maintained between 50° C. and 90° C., and preferably between 65° C. and 75° C. It has been observed that the temperature of the solution may influence the efficiency of the electrolytic process, especially because it affects the time needed to obtain the desired deposit. This influence is scarcely felt in a favorable way until about 50° C. and reaches its maximum effect between 65° C. and 75° C. The temperature preferably should not exceed g0° C. in order to avoid risk of boiling and vaporization of the solution, which would alter its composition.

According to another characteristic of the process of the invention, the electrofluxing solution has a density between 30° Be and 50° Be, and preferably in the vicinity of 40° Be. A density higher than 50° Be leads to a risk of supersaturation of the constituents of the solution, and consequently to difficulties of keeping the constituents in solution, whereas a density below 30° Be leads to a very low deposition rate and to an irregular deposit. This density decreases as a result of deposition of metal, and it may be maintained advantageously by adding especially $ZnCl_2$ to the solution.

Lastly, one of the operating characteristics of electrofluxing in accordance with the invention consists in the deposition, on the surface of the product, by electrolytic means, of a layer of metal, for example, of zinc, as thin as possible, perfectly continuous and finely crystalline. The thickness of this layer is less than 5 microns, and preferably less than 1 micron, in order to minimize the quantity of zinc introduced into the subsequent zinc-aluminum bath.

For the electrofluxing operation aimed at by the present invention, the product to be coated constitutes the cathode and it is preferably electrically insulated, in the well known fashion, from the rest of the tank containing the electrofluxing solution. By way of example, such insulation may be assured by using electrically insulated guidance cylinders. At least one anode is immersed in the electrofluxing solution and it is preferably insulated electrically from the tank containing the electrofluxing solution. In principle, these anodes may be constituted entirely of the appropriate metal, for example, stainless steel, but they are preferably made of zinc to avoid all risk of introducing undesirable substances into the electrofluxing solution.

In order to obtain a deposit having the characteristics of thickness, continuity and crystal fineness required within the preferred limits of the invention, it is expedient to optimize the current density and the duration of electrofluxing as a function of the characteristics of the treatment line. It is necessary to take into account especially the speed of the line and the dimensions of the tank containing the electrofluxing solution.

It has appeared, in particular, that to attain the desired fineness of crystallization, the current density ought to be between 5 $A/dm^2$ and 40 $A/dm^2$ and preferably between 20 $A/dm^2$ and 35 $A/dm^2$.

Taking into account the thickness of the zinc layer to be deposited, the duration of the electrofluxing is then less than 10 seconds, and preferably less than 5 seconds, depending on the value of the current density.

At the present time, the speed of a product such as a wire in a galvanizing line is generally between 15 and 30 m/min; the short electrofluxing times required according to the invention permits the use of electrofluxing tanks of small dimensions, thereby obviously limiting the costs of installation.

The electrofluxing operation accomplished according to the present invention permits the attainment of a triple objective:

completion of the cleaning and preparation of the surface of the products, thanks to the acidity of the electrofluxing solution;

coating of the product with a thin protective layer based on zinc;

formation on this layer of a protective film having the composition of the electrofluxing solution.

The double protective layer deposited on the product by the process of the invention assures to the product an effective protection while it travels the distance to the zinc-aluminum bath. In the course of this passage, the product is dried, for example, by means of heating plates, in order to avoid the risks of spattering which would accompany the immersion of a still damp product into the zinc-aluminum bath.

At the moment of immersion of the product in the zinc-aluminum bath, the protective double layer is removed by melting and the zinc-aluminum bath is brought into contact with a smooth and clean surface which does not have any trace of oxidation. This surface affords excellent wettability, which allows a smooth and continuous zinc-aluminum coating to be obtained.

It was also observed that a zinc-aluminum bath, such as that utilized in the process of the invention, provides a fluidity superior to that of a conventional zinc bath.

One may immediately, according to a supplementary characteristic of the process of the invention, subject the product leaving the zinc-aluminum bath to the action of a protective atmosphere, in particular, of nitrogen, with the aim of avoiding the appearance of irregularities capable of harming an eventual subsequent treatment of the product. This operation is particularly desirable in the case of wires, for which irregularities of the "bamboo" type interfere with subsequent wiredrawing.

The present invention deals finally with an aqueous solution intended for electrofluxing of a ferrous product, according to the method described above, and which has the following composition:

$ZnCl_2$ : 100–700 g/l
NaCl, KCl and/or $CaCl_2$. : 5–100 g/l
NaF, HF and/or KF : 1–10 g/l
as well as contingently
$NiCl_2$ and/or $CoCl_2$ : 1–50 g/l

We claim:

1. A method of depositing a protective zinc-aluminum coating on a ferrous substrate comprising the steps of immersing the substrate in an electrolytic solution comprised of an aqueous solution containing zinc chloride, a fluoride, and at least one of $NiCl_2$ and $CoCl_2$, electrodepositing on said substrate a thin pre-coating comprising zinc, said electrolytic bath also functioning as a flux such that the thin electrodeposited coating of zinc will have thereon a flux coating of said electrolyte as the substrate is removed from the electrolytic bath; removing the pre-coated substrate from the electrolytic bath, thereafter immersing the pre-coated substrate in a molten metal bath containing zinc and aluminum so as to deposit a zinc-aluminum protective coating on said substrate, and removing said substrate from said molten bath.

2. A method according to claim 1 wherein said molten bath contains from about 3–15% aluminum and trace amounts of mischmetal.

3. A method according to claim 2 wherein said electrolytic solution also contains at least one chloride salt other than zinc chloride, $NiCl_2$ and $CoCl_2$.

4. A method according to claim 3 wherein said chloride salt other than zinc chloride, $NiCl_2$ and $CoCl_2$ is selected from NaCl, KCl or $CaCl_2$.

5. A method according to claim 3 wherein said electrolytic bath contains at least 100 g/l of $ZnCl_2$, from 5–100 g/l of a chloride selected from NaCl, KCl or $CaCl_2$, and from 1–10 g/l of a fluoride.

6. A method according to claim 5 wherein said electrolytic bath contains from about 100 g/l to about 700 g/l $ZnCl_2$.

7. A method according to claim 6 wherein said fluoride is selected from the group consisting of NaF, KF and HF.

8. A method according to claim 6 wherein said electrolytic solution contains from 1 to 50 g/l of at least one of $NiCl_2$ and $CoCl_2$.

9. A method according to claim 6 including the step of maintaining the pH of the electrolytic solution between 0.5 and 3.

10. A method according to claim 9 including the step of maintaining the pH of the electrolytic solution at about 1.

11. A method according to claim 6 wherein said electrolytic solution has a density between about 30° Be and 50° Be.

12. A method according to claim 11 wherein said electrolytic solution has a density of about 40° Be.

13. A method according to claim 6 including the step of drying the precoated substrate prior to immersing it in said molten bath.

14. A method according to claim 6 including the step of maintaining the temperature of the electrolytic solution between about 50° C. and about 90° C.

15. A method according to claim 14 including the step of maintaining the temperature of the electrolytic solution between about 65° C. and 75° C.

16. A method according to claim 6 including the step of maintaining the current density in the electrolytic solution between about 5 $A/dm^2$ and 40 $A/dm^2$ so as to electrodeposit a thin zinc coating on said substrate.

17. A method according to claim 16 including the step of maintaining the current density in the electrolytic solution between about 20 $A/dm^2$ and 35 $A/dm^2$.

18. A method according to claim 6 wherein said thin electrodeposited coating comprising zinc is less than 5 microns thick.

19. A method according to claim 18 wherein said thin electrodeposited coating comprising zinc is less than 1 micron thick.

* * * * *

UNITED STATES PATENT AND TRADEMARK OFFICE

CERTIFICATE OF CORRECTION

PATENT NO. : 4,738,758

DATED : April 19, 1988

INVENTOR(S) : Bruno Renaux et. al.

It is certified that error appears in the above-identified patent and that said Letters Patent is hereby corrected as shown below:

Column 3, line 59, "g0°C" should read --90°C--;

Signed and Sealed this

Fourth Day of October, 1988

*Attest:*

DONALD J. QUIGG

*Attesting Officer*

*Commissioner of Patents and Trademarks*